US005280260A

United States Patent [19]

Juds et al.

[11] Patent Number: 5,280,260

[45] Date of Patent: Jan. 18, 1994

[54] ROTARY SOLENOID UTILIZING CONCURRENTLY ENERGIZED AC AND DC COILS

[75] Inventors: Mark A. Juds, New Berlin; Bruce C. Beihoff, Wauwatosa, Wis.

[73] Assignee: Eaton Corporation, Cleveland, Ohio

[21] Appl. No.: 928,592

[22] Filed: Aug. 13, 1992

[51] Int. Cl.[5] ..... H01F 5/00; H01F 7/08; H01F 7/18

[52] U.S. Cl. ..... 335/266; 335/268

[58] Field of Search ..... 335/266, 268, 272, 136, 335/147, 177, 178, 180, 181, 256; 310/36; 318/140

[56] References Cited

U.S. PATENT DOCUMENTS 4,567,407 1/1986 Ecklin ..... 318/140

*Primary Examiner*—Harold Broome

*Attorney, Agent, or Firm*—L. H. Uthoff

[57] ABSTRACT

A rotary solenoid having at least one AC coil and at least one DC coil where the AC coil and the DC coil are concurrently energized by an AC electrical source and a DC electrical source, respectively for enhanced actuation torque and low noise with decreased temperature rise and package size.

7 Claims, 5 Drawing Sheets

FIG 2
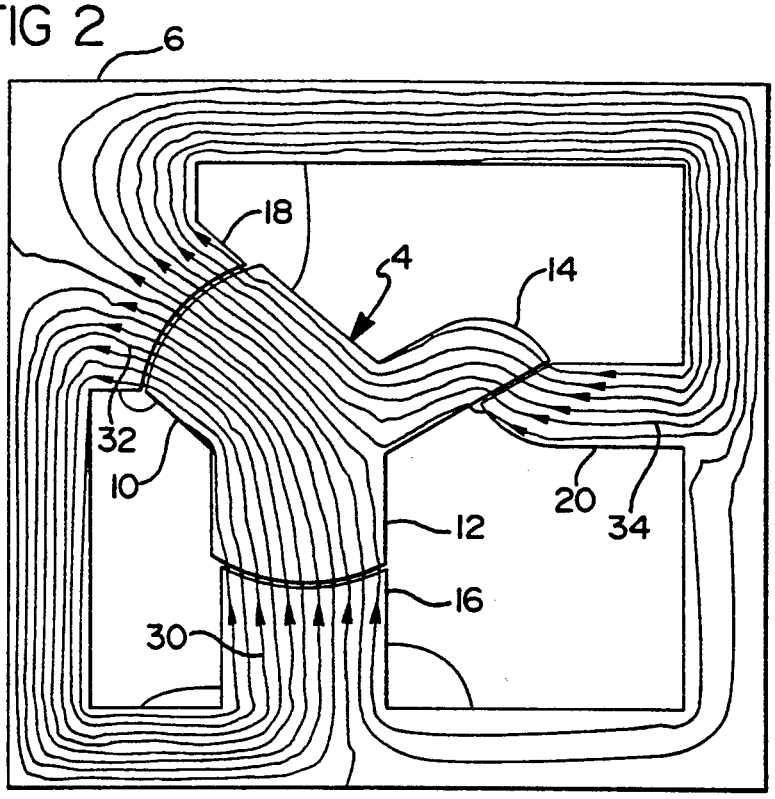
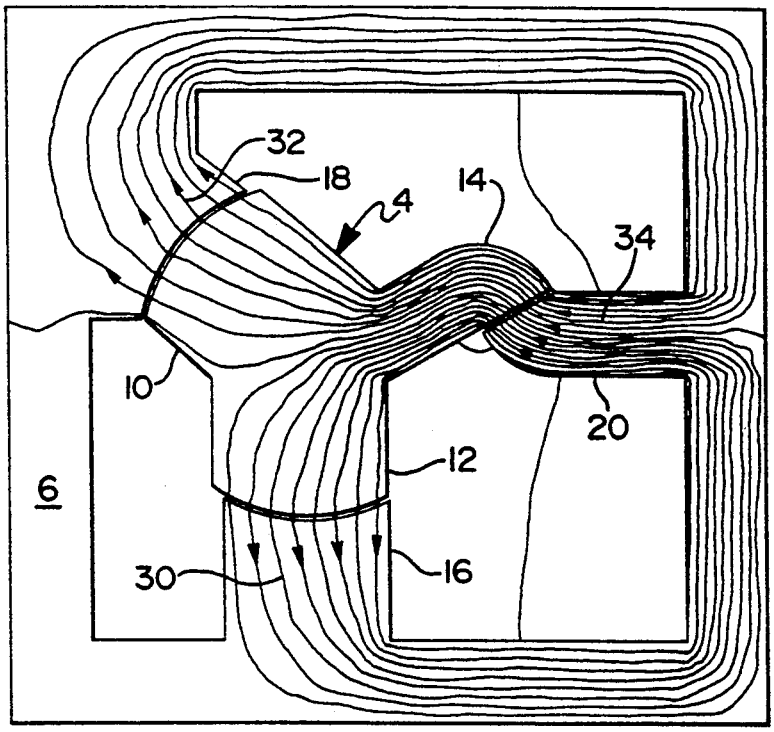
FIG 3

FIG 4
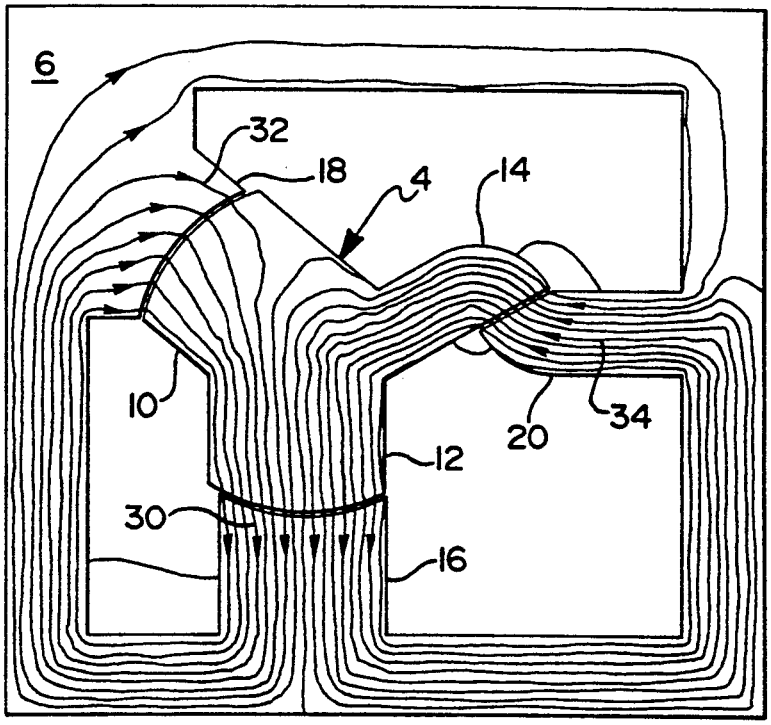
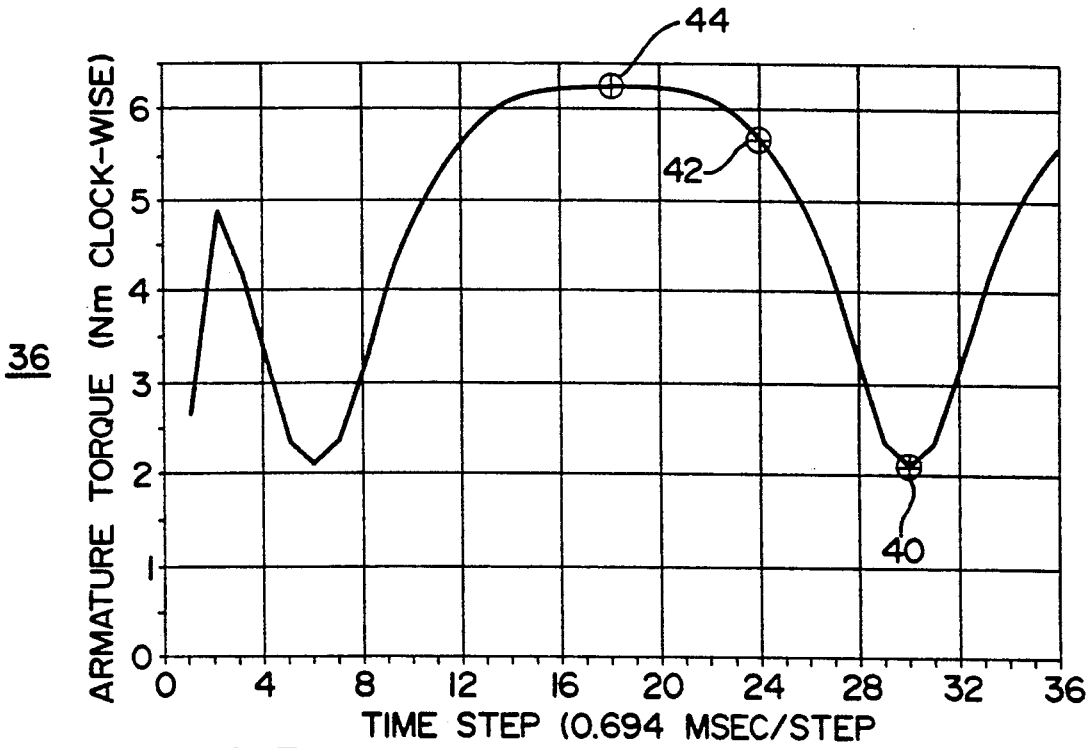
FIG 5

FIG 6
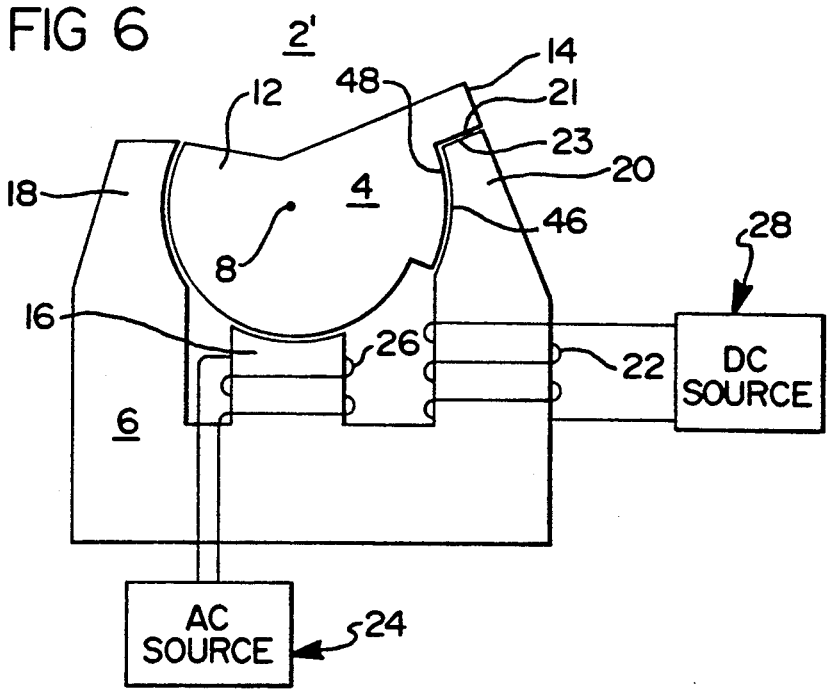
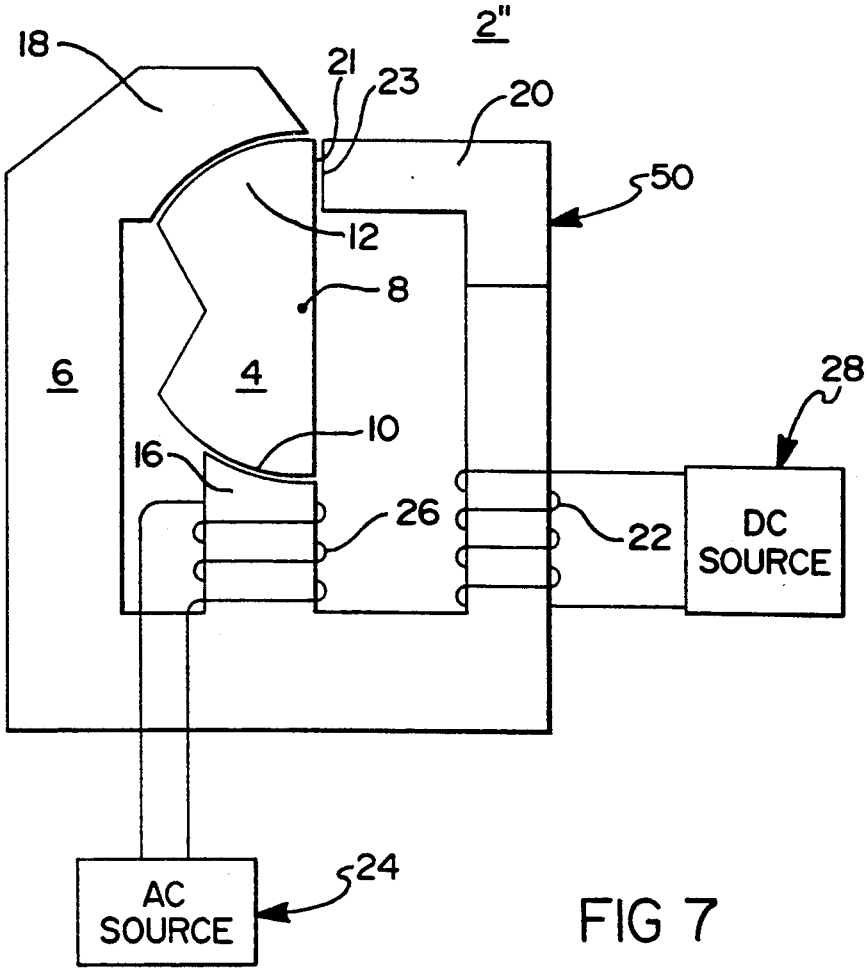
FIG 7

FIG 8
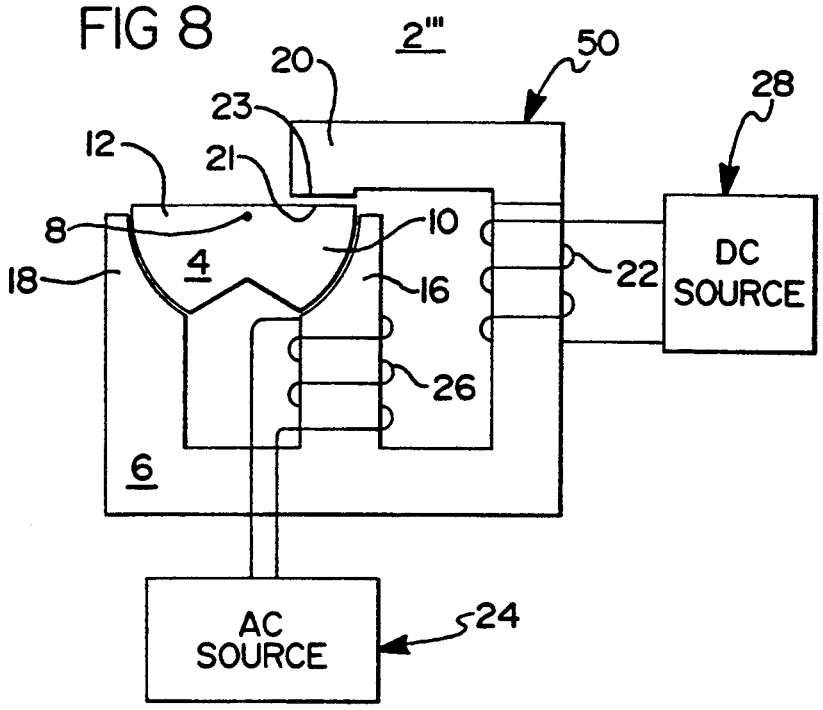
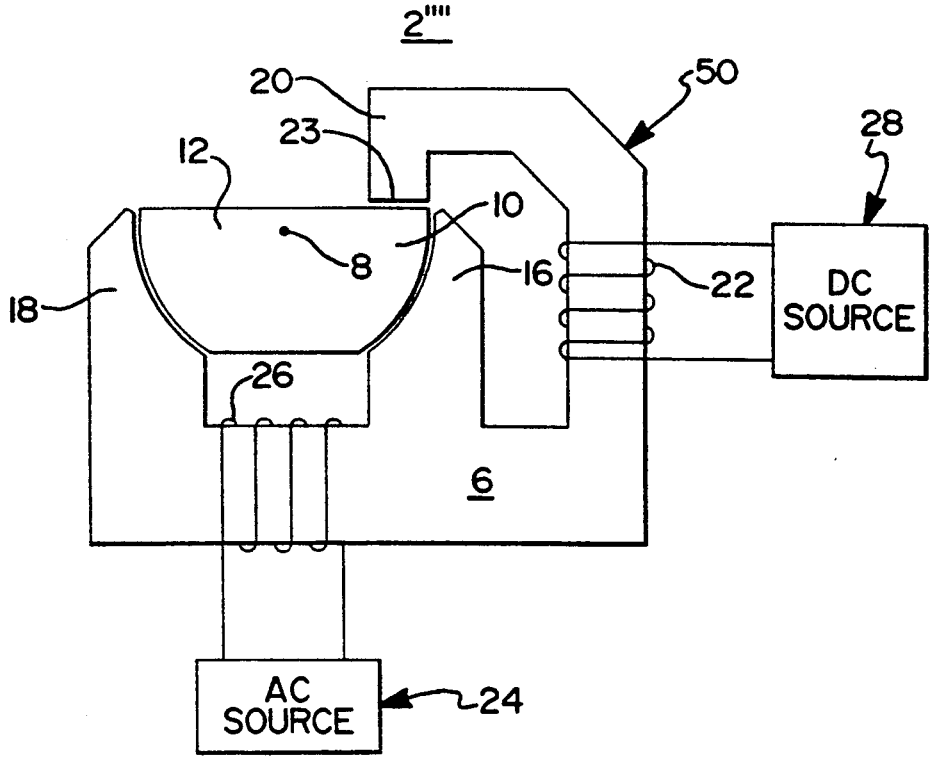
FIG 9

ROTARY SOLENOID UTILIZING CONCURRENTLY ENERGIZED AC AND DC COILS

FIELD OF THE INVENTION

This invention relates to a rotary solenoid employing at least one pole energized with an alternating current and another pole energized with a direct current. More specifically, the present invention relates to a rotary solenoid having one coil energized by a continuous alternating current which establishes a first magnetic field and a second coil energized by a continuous direct current which establishes a second magnetic field where the alternating current coil dominates the closing force and the direct current coil dominates the holding force to provide for a lower noise device.

BACKGROUND OF THE INVENTION

Various types of equipment including power electronics use solenoids to convert electrical power into mechanical motion. Generally, alternating current (AC) solenoids are used because of the wide availability of AC power from wall outlets. The primary problem with AC powered solenoid is the buzzing encountered when the linear or rotary element is powered into its energized position. The buzzing noise is caused by the cyclic nature of the AC current starting at zero rising to a maximum positive value and then falling through zero reaching a maximum negative value. For example, if common 60 cycles AC current is used, the buzzing would be at a rate of 120 cycles per second. Common problems with this type of AC induced noise occurs in household and office equipment and in specialized applications such as high power electrical contactors used in military equipment.

Direct current (DC) solenoids do not exhibit the aforementioned buzzing noise when their motion producing elements are energized into their extended position. It is known to those skilled in the art that an AC energized solenoid has more pulling force at a given power level than a DC powered solenoid. Thus, if DC power is to be used, the solenoid must be considerably larger or higher, DC currents must be used to generate the same pulling force which can result in excessive operating temperatures. Conversely, it is known that for a given size, a DC solenoid has a higher holding force at full travel than an AC solenoid along with a much lower noise level due to the non-reversing nature of the DC source. Solenoids, such as those disclosed in U.S. Pat. Nos. 4,197,444, 4,520,332 and 3,671,899, the disclosures of which are hereby expressly incorporated by reference, disclose solenoids which use electrically energized coils to produce magnetic fields which act on a rotary or linear element to provide mechanical motion. U.S. Pat. No. 4,544,987, the disclosure of which is hereby expressly incorporated by reference, describes a magnetic switching device which uses an AC power source for energizing for activation of a switching device and subsequentially a DC current for holding the switching device in an activated position. None of these devices use simultaneous continuous energization of both the AC and DC current sources for operation of the solenoid.

SUMMARY OF THE INVENTION

AC powered solenoids are, in general, more reliable than DC powered solenoids in that they do not require mechanical switching components to prevent winding burnout. In this regard, when an AC solenoid is energized, it initially draws a relatively large current which creates a large magnetic field producing a relatively large pulling force whereby the armature of the solenoid is magnetically attracted to a pole member. However, after the armature has been moved so that it is adjacent to the pole member, the current draw of the AC winding naturally decreases because of the increased inductance thereby preventing temperature buildup which can lead to coil failure. This natural phenomena of AC powered solenoids is utilized in the present invention permitting the AC energization current to be continuously applied even in the full travel position with the poles in alignment.

The present invention provides a DC powered coil and a separate holding pole to be used where the armature contacts in its extreme position the DC holding pole where the natural high holding force levels of the DC electromagnetic field are utilized to prevent or minimize buzzing of the device due to the fluctuation in the AC produced electromagnetic field which continues to be energized.

Thus, by using the present invention, the advantages of the high pulling force of the AC excited field is utilized in conjunction to the high holding force of the DC powered field to provide a high performance low noise rotary solenoid without special switching elements and with minimum size coils.

A provision of the present invention is to provide a low noise rotary solenoid device utilizing an AC energized coil and a DC energized coil.

Another provision of the present invention is to provide a low noise rotary solenoid device utilizing both an AC energized coil which functions primarily for solenoid pulling or rotation and a DC energized coil which functions primarily for armature position holding at full travel.

Another provision of the present invention is to provide a low noise rotary solenoid using an AC energized coil which is continuously and simultaneously energized with a DC energized coil.

Another provision of the present invention is to provide a low cost rotary solenoid utilizing an AC energized coil to produce a fluctuating field through a rotating armature simultaneously and continuously with a DC energized coil which produces an electromagnetic field concurrent with that produced by the AC energized coil to provide an enhanced holding force to eliminate the buzzing noise produced by the oscillation of the electromagnetic field generated by the AC energized coil.

DESCRIPTION OF THE DRAWINGS

FIG. 2 is a schematic representation of the rotary solenoid of the present invention showing the magnetic flux lines with both the AC and DC coils energized;

FIG. 3 is a schematic representation of the magnetic flux lines of the rotary solenoid of the present invention when the AC and DC coils are energized with the AC current falling through zero;

FIG. 4 is a schematic of the electromagnetic field of the rotary solenoid of the present invention where both the AC and DC coils are energized with the AC current flowing in the opposite direction to that shown in FIG. 2 and at maximum amplitude;

FIG. 5 is a graph of the armature torque versus time for the rotary solenoid of the present invention;

FIG. 6 is a cross-sectional view of an alternate embodiment of the rotary solenoid of the present invention;

FIG. 7 is a cross-sectional view of an alternate embodiment of the rotary solenoid of the present invention;

FIG. 8 is a cross-sectional view of an alternate embodiment of the rotary solenoid of the present invention; and FIG. 9 is a cross-sectional view of an alternate embodiment of the rotary solenoid of the present invention.

DESCRIPTION OF THE PREFERRED EMBODIMENT

Figure 1:
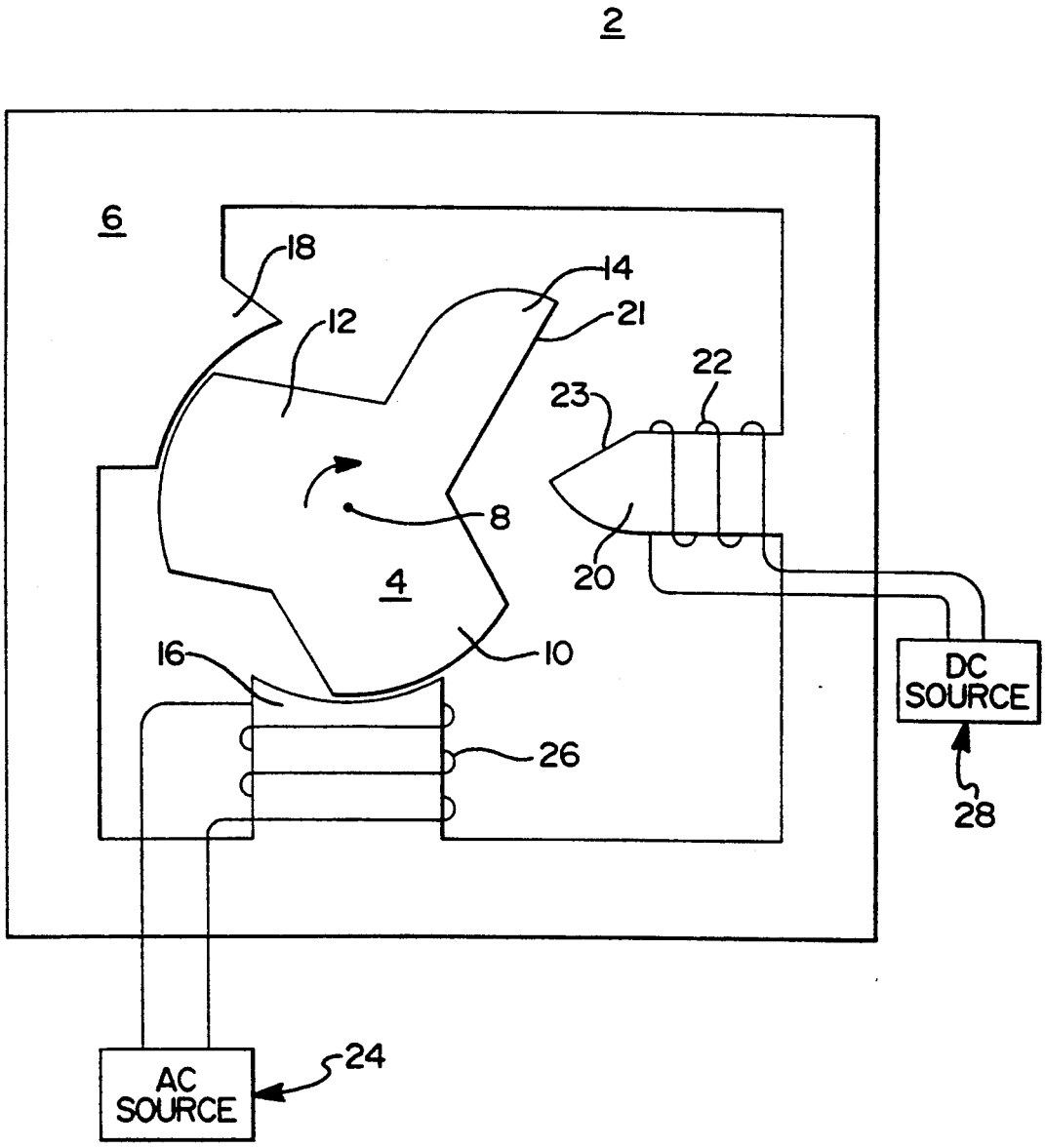
FIG. 1 is a cross-sectional view of a rotary solenoid of the present invention utilizing a continuous frame member.

Referring to FIG. 1, a rotary solenoid 2 of the present invention is shown which includes a rotating armature 4 contained and rotatably supported within a frame 6 where the armature 4 and the frame 6 are made of a material having a high content of iron to promote the establishment of a magnetic field within the material. Although this is the preferred material, any type of magnetic compatible material could be used for either component. The armature 4 is shaped so as to form a first AC armature pole 10 extending radially from the armature pivot 8 and a second AC armature pole 12 also radially extending from the armature pivot 8 and a DC armature pole 14 which also extends radially from the armature pivot 8. The first AC armature pole has a peripheral surface whose cross section is circular in nature having a radius established from the armature pivot 8 to the peripheral surface. Likewise, the second AC armature pole is formed in a similar manner. The DC armature pole 14 is generally extended radially from the armature pivot but has no specific shape other than a sufficient cross section to conduct the magnetic field contained therein at all points in the operation of the rotary solenoid 2.

The frame 6 has a portion which extends from the inner part of the frame 16 known as a first AC frame pole whose peripheral surface facing in the direction of the armature pivot 8 is a curvature similar to that of the first AC armature pole such that as the armature 4 pivots on the armature pivot 8 the outer peripheral surface of the first AC armature pole comes in close proximity to the inner peripheral surface of the first AC frame pole. In a similar fashion, a second AC armature pole 12 comes in close proximity to a second AC frame pole 18 which extends from the inner surface of the frame 6 as the armature 4 is rotated to the closed position established when the first AC armature pole 10 and the second AC armature pole 12 are in respective alignment with the first AC frame pole 16 and the second AC frame pole 18.

Wrapped around either the first AC frame 16 and/or the second AC frame pole 18 is a multiplicity of turns of electrically conducting wire wrapped in a continuous fashion to establish and form an AC coil 26 which is connected to an AC electrical source 24 which serves to supply the AC coil 26 with an electrical current source which alternates in direction at a given amplitude.

Also extending inwardly from the frame 6 is a DC frame pole 20 having a flat DC pole surface 23 which comes in contact with a flat portion of the DC armature pole 14 known as the holding contact surface 21 where the holding contact surface 21 meets the DC pole surface 23 when the armature 4 is rotated in a fully energized position and is held thereto with a holding force generated by a flow of DC current established in the DC coil 22. The DC coil is formed of a multiplicity of turns of electrically conducting wire wrapped around the DC frame pole 20 and is energized by DC electrical source 28.

Thus, in operation, the armature 4 is fully rotated in a counterclockwise direction with the unenergized position limit established by some type of mechanical stop within the device whose motion is to be controlled by the rotation of the armature 4 or within the workings of the rotary solenoid 2. Both the first AC armature pole 10 and the second AC armature pole 12 are in substantial misalignment with the first AC frame pole 16 and the second AC frame pole 18 and the holding contact surface 21 is at its largest distance from the DC pole surface 23. At this position, very little if any current is flowing from the AC source 24 or the DC source 28. When it is desired to activate the rotary solenoid 2 by action of the rotation of the armature 4, both the AC electrical source 24 and the DC electrical source 28 are switched so as to supply electrical power to the AC coil 26 and DC coil 22 respectively. Upon energization of both the DC coil 22 and the AC coil 26, the armature is forced to rotate in clockwise direction as shown by the arrow in FIG. 1. The excitation of the AC coil 26 establishes the magnetic field within the frame 6 and is the primary source of rotation force exerted on the armature intending to bring the first AC armature pole 10 and the second AC armature pole 12 in substantial alignment with the first AC frame pole 16 and the second AC frame pole 18 respectively. As the armature 4 continues to rotate in a clockwise direction, it continues till the holding contact surface 21 meets the DC pole surface 23 whereupon the AC magnetic field generated by the alternating current present in the AC coil 26 and the DC field generated by the DC current in DC coil 22 both firmly hold the armature 4 in the fully clockwise direction where the AC electrical source 24 is changing the sign of the voltage so that the armature with just the AC electrical source connected would tend to buzz. However, with the use of a simultaneously energized DC electrical source 28 the holding contact surface 21 is held with a firm almost continuous force to the DC pole surface 23 by the DC magnetic field established by the DC coil 22. This provides for a higher holding force on the armature 4 in a fully clockwise direction with a minimum of noise using a relatively low value AC electrical source and a low value DC electrical source. The low value DC electrical source prevents excessive heating of the rotary solenoid 2 which can result in performance degradation or complete failure.

FIGS. 2, 3, and 4 are schematic representations of the AC and the DC generated magnetic fields in the frame 6 and the armature 4 when the armature 4 is in the fully energized clockwise direction. Referring specifically to FIG. 2, the AC field which oscillates in direction in a complementary direction to that established by the DC magnetic field 34 where the first AC magnetic field 30 flows from the first AC frame pole 16 through a small air gap into the second AC armature pole 12. In a similar fashion the second AC magnetic field 32 flows from the first AC armature pole 10 through a small air gap into the second AC frame pole 18. The DC magnetic field 34 flows through the DC frame pole into the DC armature pole 14 through a direct metal-to-metal contact between the holding contact surface 21 and the DC pole surface 23 or through a small gap between the holding contact surface 21 and the DC pole surface 23. In one embodiment, the first AC frame pole 16 and the second AC frame pole 18 and the DC frame pole 20 all have sufficient cross-sectional area such that the DC generated magnetic flux never detrimentally interferes with the AC generated magnetic flux.

As the AC electrical source 24 reverses direction and nears the point of zero current, the first AC magnetic field 30 and the second AC magnetic field 32 are diminished in value and the DC magnetic field 34 provides the majority of the holding force on the armature 4 as shown in FIG. 3.

As the first AC magnetic field 30 and the second AC magnetic field 32 are reversed in direction and increased in amplitude, they once again act to combine with the DC magnetic field 34 to hold the armature in a fully energized clockwise state and the resultant magnetic flux lines are shown in FIG. 4.

Whereas in prior art devices, the overall force on the armature of the rotary solenoid 2 fluctuates to a large extent where the holding force varies up to a ratio of 20:1, the holding force of the present invention is reduced in overall fluctuation by a DC magnetic field 34. The fluctuation of the AC magnetic field 32 combines with the DC magnetic field to reduce the overall armature holding force variation to a ratio of 3:1 thereby providing for a very low noise device without the loud buzzing noise found in prior art solenoids.

Now referring to FIG. 5, the armature torque 36 is shown plotted against time 38 where the holding force on the armature 4 is shown as a solid line varying between a minimum value of 2 newton meters in a clockwise direction to a maximum of just over 6 newton meters. The magnitude of the magnetic flux distribution shown in FIG. 2 is shown in FIG. 5 as point 40 and the magnitude of the flux distribution shown in FIG. 3 is shown in FIG. 5 as point 42 and similarly the magnitude of the flux distribution shown in FIG. 4 is shown in FIG. 5 as point 44. Referring to the graph in FIG. 5, illustrates the low overall variation in the holding armature torque where the ratio is limited to a value of 3:1 which is dramatically reduced from the prior art AC only energization method resulting in a armature torque fluctuation ratio of approximately 20:1.

Some prior art units minimized the buzzing noise by using a switching device to use an AC powered coil for rotation and then the AC was disconnected and DC was used to energize the same or a different coil to hold the solenoid armature in position. The disadvantage of this approach is the complexity of the critical timing method that the field would have to be switched from AC to DC and the attendant increase in hardware complexity and cost.

Now referring to FIG. 6, a cross-section of an alternate embodiment of the present invention is shown as rotary solenoid 2'. The armature 4 is modified and shaped so that only the DC armature pole 14 extends radially from the armature pivot 8 and includes an additional radial surface 48 which comes in close proximity to a concave surface 46 formed on the DC frame pole 20 such that the holding contact surface 21 mechanically hits the DC pole surface 23 upon full activation of the rotary solenoid 2' in a clockwise rotation.

FIG. 7 is a cross-section of a second alternate embodiment of the present invention is shown as rotary solenoid 2'' where the frame 6 is further modified to react with the armature 4 and is shown in the fully energized state. The DC frame pole 20 consists of a separate piece 50 that is added after the DC coil 22 is placed in position. The armature 4 rotates in a clockwise direction on the armature pivot 8 until the DC pole surface 23 comes in contact with the holding contact surface 21 on the face of armature 4. Similar to the operation of the present invention as shown in FIG. 1, the first AC armature pole 10 lies in substantial alignment with the first AC frame pole 16 and the second AC armature pole 12 is in substantial alignment with the second AC frame pole 18 when the rotary solenoid 2'' as in its fully energized state. Again, both the AC electrical source 24 and DC electrical source 28 are continuously and simultaneously energized when rotation of the armature 4 is desired.

Now referring to FIG. 8, a third alternate embodiment of the present invention is shown as rotary solenoid 2'''. Again, the configuration of the frame 6 has been modified so that the DC frame pole 20 wraps around and interacts with the armature 4 by contacting the holding contact surface 21 at the DC pole surface 23 upon full rotation of the armature 4 in this embodiment in a counterclockwise rotation upon full energization. Again, as also shown in FIG. 7, a separate piece 50 is joined by the frame 6 to form the DC frame pole 20 after the DC coil 21 is installed.

Referring to FIG. 9, a fourth embodiment of the present invention is shown as rotary solenoid 2''''. In this embodiment, the AC coil 26 is wound on a different portion of the frame 6 but the operation is similar to that shown in FIG. 8. The separate piece 50 is joined to the frame 6 in a modified position where the DC coil 22 is installed on the additional piece 50 rather than on the frame 6.

It will be appreciated by those of ordinary skill in the art that many other variations in the foregoing preferred embodiments are possible while remaining within the scope of the present invention. The present invention should thus not be considered limited in the preferred embodiments or the specific choices of materials, configurations, dimensions, applications or ranges of parameters employed therein.

What is claimed is:

1. A rotary solenoid comprising:

an alternating current source of electrical power;

a direct current source of electrical power;

a frame having a central cavity contained therein, said frame having a first and a second frame pole extending into said cavity from said frame;

an armature rotatably supported by said frame and located within said cavity, said armature having a first armature pole and a second armature pole for magnetically interacting with said first frame pole and said second frame pole respectively;

a first coil excited by said alternating current source for inducing a magnetic field in said first frame pole;

a second coil excited by said direct current source for inducing a magnetic field in said second frame pole where said first coil and said second coil are exclusively currently energized by said alternating current source and said direct current source respectively and remain energized when said rotary solenoid is activated causing said second armature pole to contact said second frame pole thereby providing a high activation force and a low noise holding force.

2. The rotary solenoid of claim 1, wherein said first pole frame and said second pole frame are positioned with adequate cross-sectional area for minimizing the interference of said magnetic field in said first frame pole with said magnetic field in said second frame pole.

3. The rotary solenoid of claim 1, wherein said first coil is a multiplicity of turns of electrical wire circumferentially wound around said first frame pole.

4. The rotary solenoid of claim 1, wherein said second coil is a multiplicity of turns of electrical wire circumferentially wound around said second frame pole.

5. The rotary solenoid of claim 1, further comprising:

a third frame pole extending from said frame into said cavity and a third armature pole for magnetically interacting with said third frame pole.

6. A method of providing rotary motion comprising:

providing an alternating current source;

providing a direct current source;

providing a frame having a cavity therein, said frame having a plurality of magnetic frame poles including a first frame pole and a second frame pole;

providing an armature rotatably supported by said frame and positioned within said cavity, said armature having a plurality of armature poles including a first armature pole magnetically interacting with said first frame pole and a second armature pole magnetically interacting with said second frame pole;

providing a first coil for inducing a magnetic field in said first frame pole;

providing a second coil for inducing a magnetic field in said second frame pole;

connecting said first coil to said alternating current source; and concurrently connecting said second coil to said direct current source thereby causing said armature to rotate, said armature limited in rotation by said second armature pole contacting said second frame pole.

7. The method of providing rotary motion of claim 6, wherein said direct current source is produced by rectifying said alternating current source.

* * * * *